US005456623A

United States Patent [19]

Norris

[11] Patent Number: 5,456,623

[45] Date of Patent: Oct. 10, 1995

[54] INFLATABLE FLOTATION DEVICE

[76] Inventor: Richard H. Norris, 2786 Landmark Dr., Clearwater, Fla. 34621

[21] Appl. No.: 278,760

[22] Filed: Jul. 22, 1994

[51] Int. Cl.[6] ..... B63C 9/15

[52] U.S. Cl. ..... 441/92; 441/106; 441/108; 441/117

[58] Field of Search ..... 441/92, 93, 94, 441/104, 108, 114, 117, 119, 120, 121

[56] References Cited

U.S. PATENT DOCUMENTS

| | | | |
|---|---|---|---|
| 3,130,424 | 4/1964 | Santangelo | 441/94 |
| 3,148,393 | 9/1964 | McCuaig | 441/92 |
| 3,935,608 | 2/1976 | Freedman et al. | 441/92 |
| 4,360,351 | 11/1982 | Travinski | 441/94 |

FOREIGN PATENT DOCUMENTS

| | | | |
|---|---|---|---|
| 2184069 | 6/1987 | United Kingdom | 441/108 |

*Primary Examiner*—Sherman Basinger
*Attorney, Agent, or Firm*—Harold D. Shall

[57] ABSTRACT

An inflatable flotation device having a belt for securing same to the user. A pair of VELCRO™ carrying flaps are secured to the belt and overlap a folded inflatable bag. A release mechanism is carried by the belt and a manifold secured to the release mechanism extends through the belt and into the bag to secure the release mechanism and the bag to the belt. When the release mechanism is activated the bag inflates and opens the flaps.

1 Claim, 2 Drawing Sheets

INFLATABLE FLOTATION DEVICE

BACKGROUND OF THE INVENTION

1) Field of the Invention

This invention relates to improvements in inflatable flotation devices adapted to be secured around the body of the user and adapted to be inflated by a gas cartridge when the wearer desires to use the floatation device as a life preserver.

2) Description of Prior Art

It is known that inflatable flotation devices are much less bulky when worn than lifejackets which are permanently filled with bulky material such as kapok. Since they are less bulky and do not restrict the users movements, inflatable devices are more likely to be worn than permanently filled devices.

Previous inflatable devices such as those shown in U.S. Pat. Nos. 4,360,351 and 4,842,562 are either restricted in size and compress against the users body or are limited in size because the inflatable portion fits against the users body and are a part of the belt securing the inflatable portion to the body.

It is therefore, an object of this invention to provide an inflatable flotation device which is carried on a belt-like device worn around the users waist or upper torso with the inflatable portion not being limited in size by the belt portion or forming a integral part of the belt like device so that the size of the inflatable portion is not controlled by the belt and when inflated, the device does not exert a pressure upon the wearer.

SUMMARY OF THE INVENTION

The present invention includes a belt which is secured around the users waist or upper torso. The belt, at the front thereof, carries a pair of flaps with securing means, such as VELCRO™ strips thereon, which flaps close over a folded up inflatable bag. An inflation-cartridge holder is secured to the belt and carries the inflatable bag and a inflation cartridge. When the inflation-cartridge is activated, the inflatable bag is inflated, during which time the pair of flaps pop open and release the bag to become fully inflated. Since the bag is not a part of the belt, the size thereof not limited by the belt, and inflation thereof does not press upon the user. When the bag is inflated, since it is in front of the user, the user merely grasps the bag and holds the same which keeps the user afloat in a face upward position. Both of the above mentioned prior art patents have the inflated portion at the rear of the user, and unless pulled around in front will hold the user in a face-down position.

DETAILED DESCRIPTION OF THE PREFERRED EMBODIMENT

Figure 1:
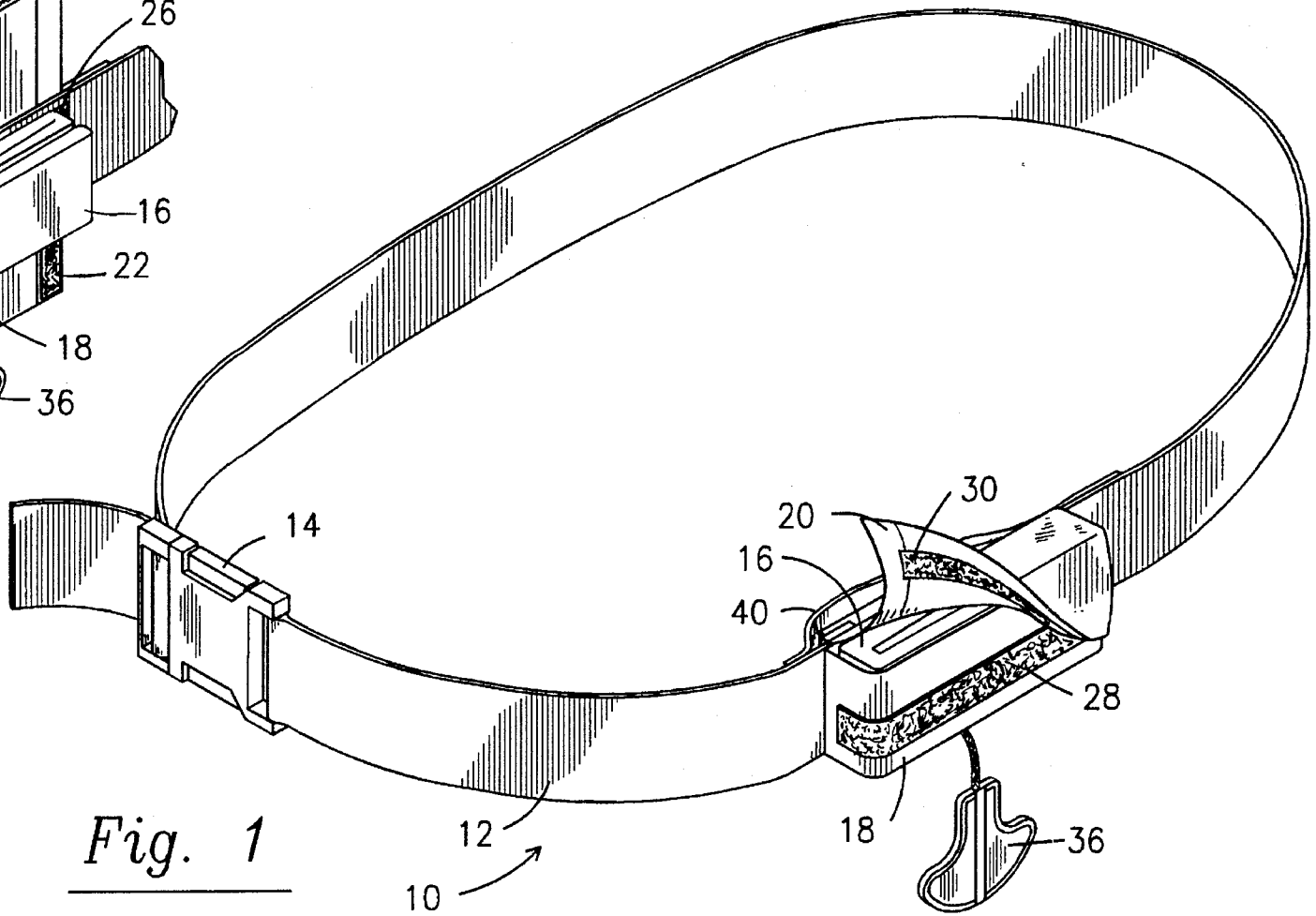
FIG. 1 is a perspective view of the invention with one of the flaps of the pair of flaps partially open.
Figure 2:
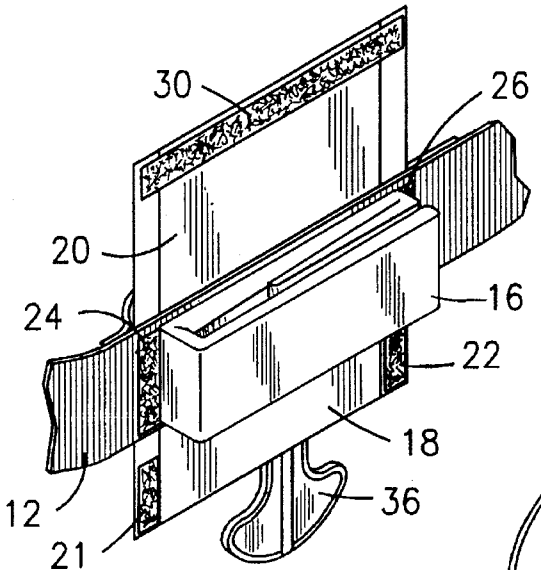
FIG. 2 is a perspective view of the flotation portion of the device with both flaps open and the flotation bag in its folded-up position.
Figure 3:
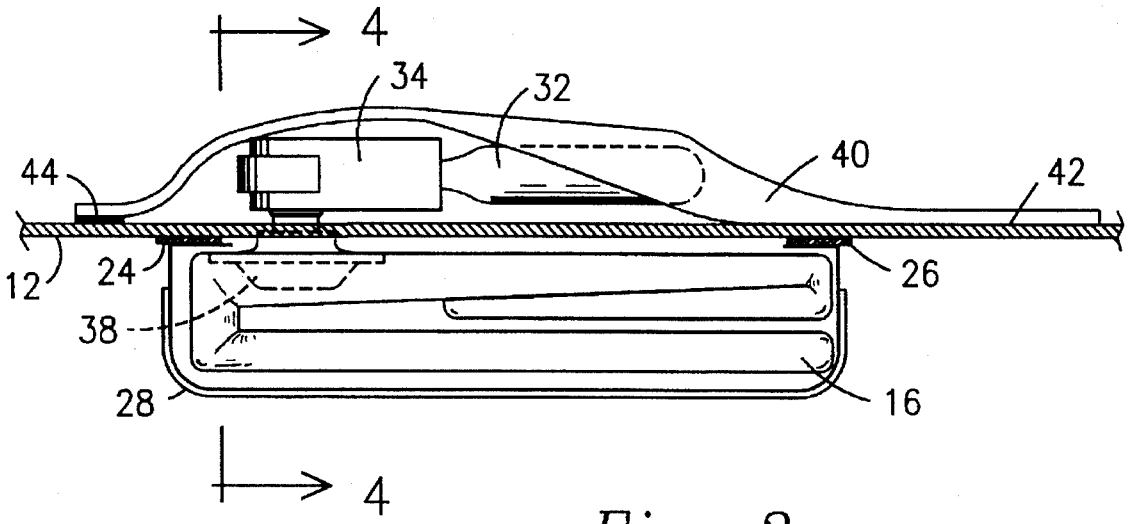
FIG. 3 is a plan view of the flotation portion of the device with the top flap sectioned for clarity.
Figure 4:
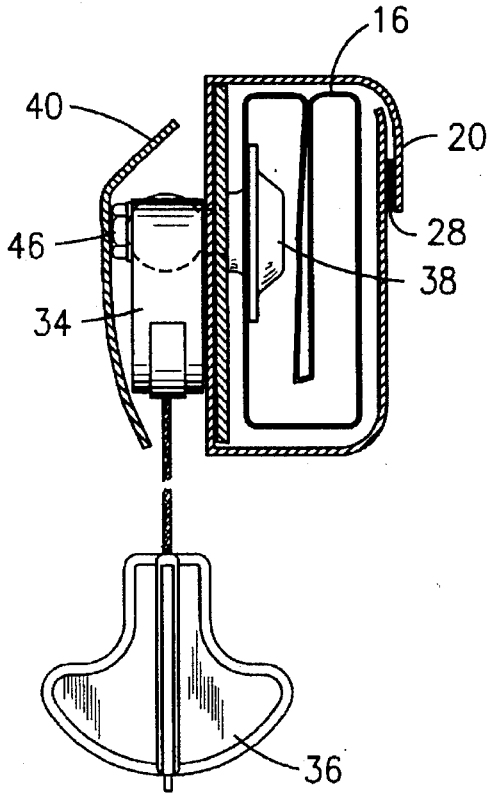
FIG. 4 is a cross sectional view taken on line 4—4 in FIG. 3 with the top flap in place.

Referring now to FIG. 1, an inflatable flotation device is shown generally at 10 and includes a belt portion 12 with a pair of interlocking plastic securing means 14 of a well known commercially available type. The belt 12, as seen in FIGS. 1 through 4, carries a folded inflatable bag 16, which bag is shown in its inflated condition in FIG. 5. The bag 16 in the ready-to-be used condition seen in FIG. 1, is folded upon itself and a pair of VELCRO™ (hook and eye material) strip carrying flaps 18 and 20 are folded over and secured to each other thereby enclosing the bag 16. The flaps 18 and 20 are one piece and are sewn to the belt 12.

The flap 18 carries a pair of laterally spaced VELCRO™ strips 21 and 22 which cooperate with VELCRO™ strips 24 and 26 respectively, carried by the belt 12. The flaps 18 also carries a VELCRO™ strip 28 thereon which cooperates with a VELCRO™ strip 30 carried by the flap 20 so that when the flap 20 is folded over the flap 18, the flaps enclose and carry the inflatable bag 16.

An inflation cartridge 32,of the standard commercially available CO 2 inflator type, is carried by a release mechanism 34 which has an actuating cord 36 depending therefrom. The release mechanism is of a well known commercially available type which can be obtained from HENCO in St. Petersburg, Fla. and is described in detail in U.S. Pat. No. 4,946,067. Screwed into the release mechanism is a gas outlet manifold 38 which extends into and is sealingly secured to the inflatable bag 16 and directs the flow of gas from the release mechanism 34 into (or out of as hereinafter described) the bag 16. When the activating cord 36, is pulled, the released mechanism pierces the inflation cartridge 32 in a manner described in U.S. Pat. No. 4,946,067, and gas from the cartridge 32 flows into the inflatable bag 16. The gas outlet manifold 38 passes through the belt 12 and secures the release mechanism to the belt, while a flap of material 40 (the same nylon webbing as the material of the belt) is sewn to the belt 12 at one end thereof as shown at 42 and overlies the release mechanism 34 and the cartridge 32. The other end of the flap 48 is secured to the belt 12 by a VELCRO™ strip 44. By detaching the VELCRO™ strip 44, the flap 40 can be lifted to provide access to replacing the cartridge 32 and for removing and retaining nut 46 carried by the release mechanism 34. When it is desired to deflate the inflatable bag 16 after use, the nut 46 can be removed and the bag 16 deflated. Once deflated the bag 16 can again be folded and placed within the flaps 18 and 20 for reuse.

Figure 5:
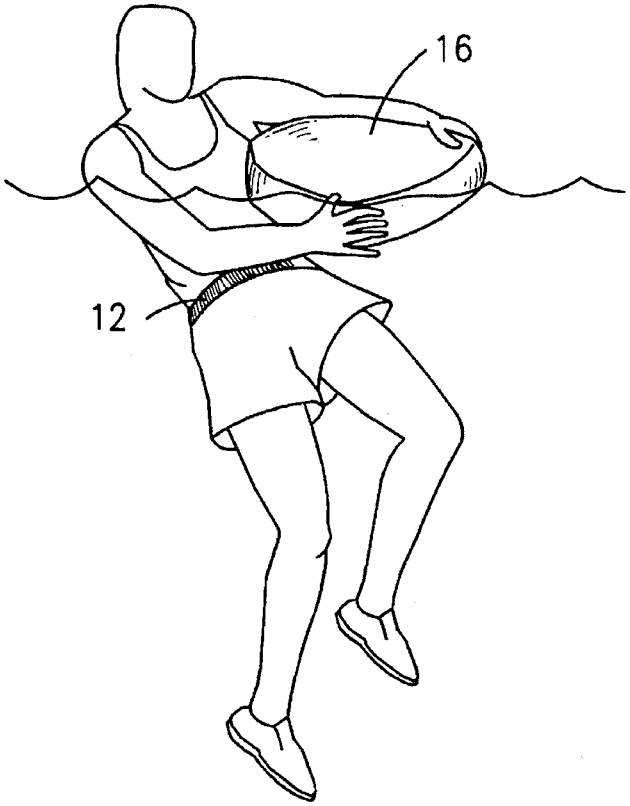
FIG. 5 shows the user with the inflated device.

As shown in FIG. 5, once the bag 16 is inflated, it is readily available to provide buoyancy to the user and since it is at the upper front of the body, it will retain the user in a face upright position.

Although the above description relates to a presently preferred embodiment, numerous changes can be made therein without departing from the scope of this invention as claimed in the following claims.

What is claimed is:

1. An inflatable flotation device comprising in combination, (a) a belt having securing means thereon for securing the same about the body of the user, (b) a pair of overlapable flaps carried by said belt, 1) said flaps having hook-eye strips thereon for securing said flaps to each other to form a pouch, (c) an inflatable bag disposed adjacent said belt and folded to be carried within the pouch formed by said flaps, (d) a release mechanism located adjacent said belt and disposed on the side of said belt opposite said inflatable bag, (e) a gas outlet manifold with a portion disposed in said inflatable bag and a portion thereof extending through said belt and into said release mechanism thereby securing said release mechanism and said bag to said belt, (f) an inflation cartridge carried by said release mechanism, (g) whereby upon actuation of said release mechanism the cartridge inflates said bag which opens said flaps, and (h) a flap carried by said belt on the side of said belt opposite said bag and at a location overlying said release mechanism and said cartridge, said flap being secured to said belt by sewing at one end thereof and by hook-eye means at the other end thereof whereby said release mechanism may be accessed by undoing said hook-eye means.

* * * * *